US006106145A

United States Patent [19]

Winslow

[11] Patent Number: 6,106,145

[45] Date of Patent: Aug. 22, 2000

[54] ADJUSTABLE HOMOGENIZER DEVICE

[75] Inventor: Donald Winslow, Houston, Tex.

[73] Assignee: Baker Hughes Incorporated, Houston, Tex.

[21] Appl. No.: 09/283,119

[22] Filed: Mar. 31, 1999

[51] Int. Cl.[7] ..... B01F 5/06

[52] U.S. Cl. ..... 366/176.2; 366/336; 138/45

[58] Field of Search ..... 366/167.1, 174.1, 366/175.2, 176.1, 176.2, 182.1, 336, 337, 338, 340; 137/625.33; 251/120, 121; 138/40, 42–46

[56] References Cited

U.S. PATENT DOCUMENTS

| | | | |
|---|---|---|---|
| 2,304,456 | 12/1942 | Hall . | |
| 2,737,979 | 3/1956 | Parker . | |
| 2,868,516 | 1/1959 | Moseley | 366/176.2 |
| 2,882,025 | 4/1959 | Loo | 366/176.1 |
| 3,152,617 | 10/1964 | Justus et al. . | |
| 3,417,967 | 12/1968 | Richens et al. . | |
| 3,515,370 | 6/1970 | Jester et al. . | |
| 4,044,991 | 8/1977 | Waller | 138/46 |
| 4,188,277 | 2/1980 | Martin . | |
| 4,209,374 | 6/1980 | Martin . | |
| 4,270,576 | 6/1981 | Takeda et al. . | |
| 4,352,572 | 10/1982 | Chen et al. . | |
| 4,363,464 | 12/1982 | Spils | 251/121 |
| 4,374,724 | 2/1983 | Robinson . | |
| 4,494,731 | 1/1985 | Spils | 251/121 |
| 4,533,254 | 8/1985 | Cook et al. . | |
| 4,726,686 | 2/1988 | Wolf et al. . | |
| 5,382,411 | 1/1995 | Allen . | |
| 5,426,137 | 6/1995 | Allen . | |
| 5,482,369 | 1/1996 | Verstallen . | |
| 5,547,281 | 8/1996 | Brooks . | |
| 5,720,551 | 2/1998 | Shechter . | |
| 5,782,557 | 7/1998 | Young | 366/340 |
| 5,843,334 | 12/1998 | Saheki et al. . | |

*Primary Examiner*—Charles E. Cooley
*Attorney, Agent, or Firm*—Gerald W. Spinks

[57] ABSTRACT

An emulsification device having a mobile frame, mobile fluid deflectors, and stationary fluid deflectors, with the fluid shear deflectors being positioned in the outer periphery of the interior of the device, and with minimal flow resistance from factors other than the deflectors. Flow of component fluids passes directly through the fluid shear areas, with a minimal flow path through other flow resisting structures.

3 Claims, 3 Drawing Sheets

10
16
18
11
32
20
32
30
14
26
26
34
34
21
21
28
24
22
36
12

ADJUSTABLE HOMOGENIZER DEVICE

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of mixing devices used to create an emulsion, such as a device used to create an appropriate oil and water emulsion, in preparation for desalting and dewatering of an oil-continuous emulsion such as crude petroleum.

2. Background Information

An oil-continuous emulsion such as crude petroleum can be desalted and dehydrated by introduction of the emulsion into an electric field. The electric field will coalesce suspended droplets of the dispersed water phase, in which the salts are contained, into larger masses of salty water. The larger masses of water and salt will then gravitate from the emulsion, leaving the oil phase. The incoming crude oil typically contains some water and salt. It is typical to add water, to arrive at a water concentration of approximately 10%, and then mix the added water with the oil emulsion in a mixing device, to create a more complete emulsion of salty water and oil. This makes possible the more complete removal of salt from the oil by the electric field.

Mixing of the added water into the incoming emusion of oil and salty water is normally accomplished by pumping these components through a valve, prior to introduction of the emulsion into the electric field. In the mixing valve, the oil, salty water, and added water flow through restricted areas which create fluid shear forces to accomplish the mixing. Currently known valves used for this purpose are typically valves which were originally designed for use as control valves, rather than mixing devices. Such valves have been adapted for the mixing application because they have one or more valve discs which can be positioned in proximity to one or more respective valve seats, with the valve in a partially open position, thereby creating fluid shear forces as the fluids flow through the restricted areas between the discs and the seats. The fluid shear thusly created mixes the component fluids in a more complete emulsion.

Unfortunately, since the currently known mixing valves were originally designed as control valves, rather than mixing devices, they suffer from some disadvantages. The primary disadvantage is that, in the known mixing valves, the design of the discs, seats, and valve flow paths results in the creation of higher than necessary flow resistance. This is because a control valve is designed to control flow rates by creating flow resistance through several means, only one of which is the creation of fluid shear. Various structural elements in a typical control valve, such as the portions of the valve plug in the flow path and the flow channels in the valve body, create additional flow resistance. In these valves, the proportion of flow resistance that results from structural elements other than the fluid shear-creating elements is relatively high. This means that additional pump capacity, along with its additional capital cost and operating cost, is necessary, to achieve a given flow rate. It would be desirable to have an emulsifying device in which almost all of the flow resistance results from the fluid shear-creating elements of the device.

A second disadvantage of the currently known mixing valves is that they tend to be larger and heavier than necessary. In the typical such valve, the surfaces which actually create fluid shear forces, namely the disc and seat surfaces, tend to occupy the central region of the valve body cavity, with peripheral valve body areas being necessarily devoted to flow channeling structures. This means that, not only is the valve large, heavy, and complex, but the total shear-creating surface area has not been optimized. It would be desirable to have an emulsifying device in which the surface utilized for creating fluid shear is as large as possible for a given size body, with the shear-creating surfaces ideally occupying the peripheral portion of the valve body cavity, rather than only the central portion.

BRIEF SUMMARY OF THE INVENTION

The present invention is an emulsifying device which has been designed solely as a device for creating an emulsion, in which almost all of the fluid flow resistance results from the creation of fluid shear forces, and in which the surfaces used for creation of fluid shear forces are as large as possible, occupying the peripheral portion of the internal cavity of the emulsifying device. A hollow, generally cylindrical body has a plurality of stationary fluid shear rings or flanges extending radially inwardly therefrom. The hollow body contains a movable cylindrical frame for positioning a plurality of movable fluid shear rings or flanges in desired proximity to the stationary fluid shear rings. The cylindrical frame has the shape of a cylindrical bobbin, and the movable fluid shear rings are attached as flanges extending radially outwardly from the bobbin. The axial position of the bobbin within the body, and therefore the axial positions of the movable fluid shear rings, are controlled by a control device such as a handwheel, which is attached to the bobbin by an operating stem. The position of the bobbin is adjusted to create the desired amount of fluid shear between the movable fluid shear rings and the stationary fluid shear rings, to thereby achieve the desired amount of emulsification. The efficiency of the downstream desalting device is monitored to determine the optimum position for the bobbin.

A portion of the fluid to be emulsified enters the hollow body and flows directly through at least one set of fluid shear rings, while the remainder of the fluid flows through the center of the cylindrical bobbin and then through at least one other set of fluid shear rings. After passing through the fluid shear rings, the emulsified fluid flows around the outside of the bobbin to an outlet in the side of the body. There is no central valve plug, and there are no fluid flow channels formed in the body of the device, thereby minimizing the amount of fluid resistance that results from structures other than the fluid shear rings. The stationary fluid shear rings and the movable fluid shear rings are located in the peripheral area of the cavity of the hollow body, thereby maximizing the size of the surfaces used for creation of fluid shear forces, for a given size body.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
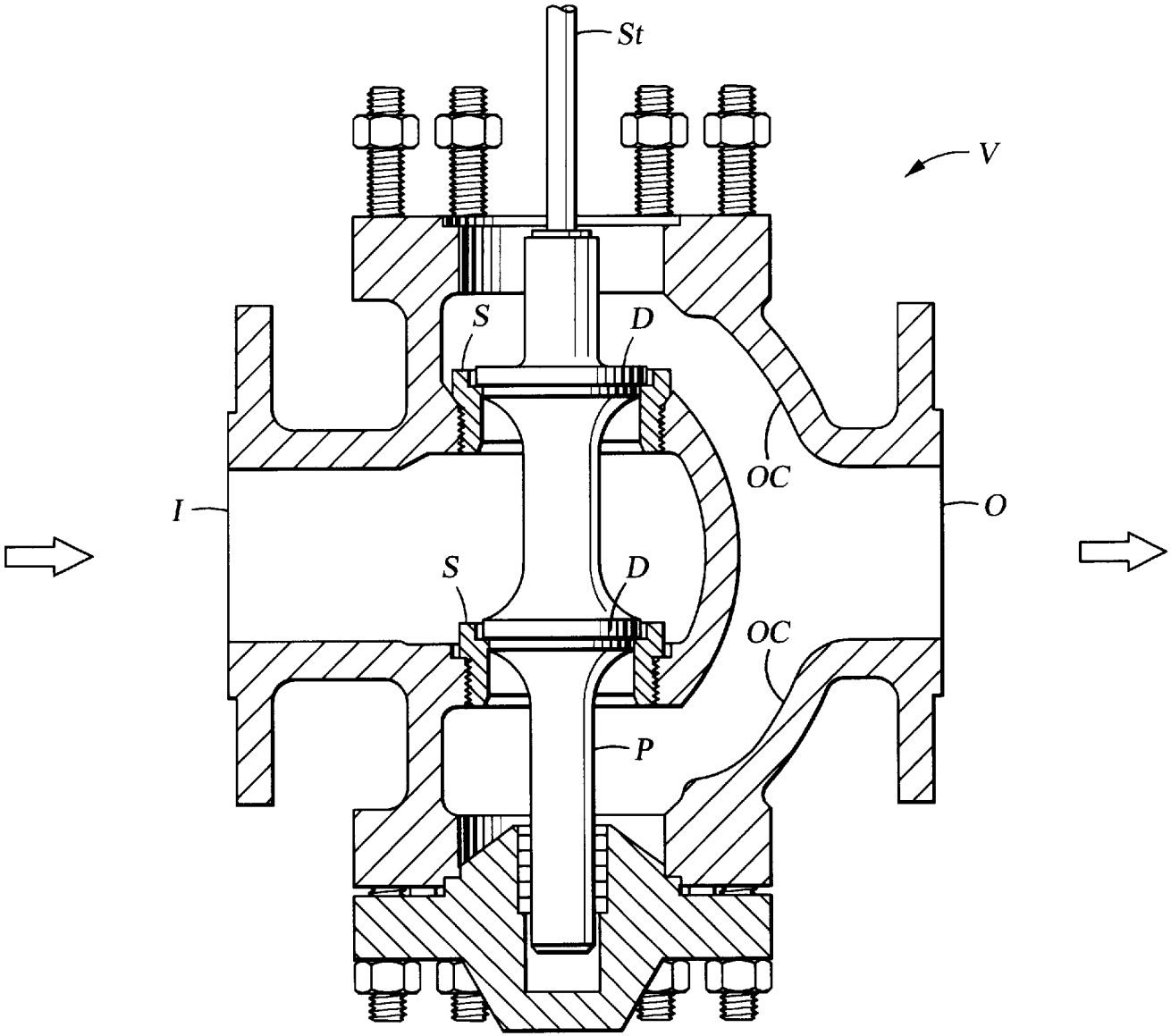
Fig. 1 (PRIOR ART)
FIG. 1 is a section view of a typical control valve of the type currently used as a mixing valve in desalting operations.

As seen in FIG. 1, the typical currently known emulsion mixing valve V is actually a dual port control valve, having an inlet port I, an outlet port O, and a movable valve plug P. The valve plug P is moved vertically by a handwheel (not shown) which is attached to a valve stem St. The valve plug P has two valve discs D, which align with two valve seats S, with the valve seats S being mounted in the central portion of the valve body. Above, below, and to the right of the valve seats S are a plurality of flow outlet channels OC, formed in the peripheral portion of the valve body.

The component fluids to be emulsified flow into the inlet I, and around the central portion of the valve plug P between the discs D. The central portion of the valve plug P has smooth surfaces to limit the flow resistance, but an appreciable resistance is still created, by means of the flow restriction created by the valve plug P. After flowing around the valve plug, fluid flow is directed through the areas between the respective valve discs D and valve seats S, where fluid shear forces are created, according to the degree to which the valve is opened. As illustrated, the valve is closed, but in operation, it would always be at least slightly open.

After passing through the areas between the valve discs D and the valve seats S, the emulsified fluid must pass through the various outlet channels OC, which direct flow to the outlet port O. It can easily be seen that the central portion of the valve plug P and the outlet channels OC create flow resistance which results in an appreciable portion of the total flow resistance generated by the control valve.

Figure 2:
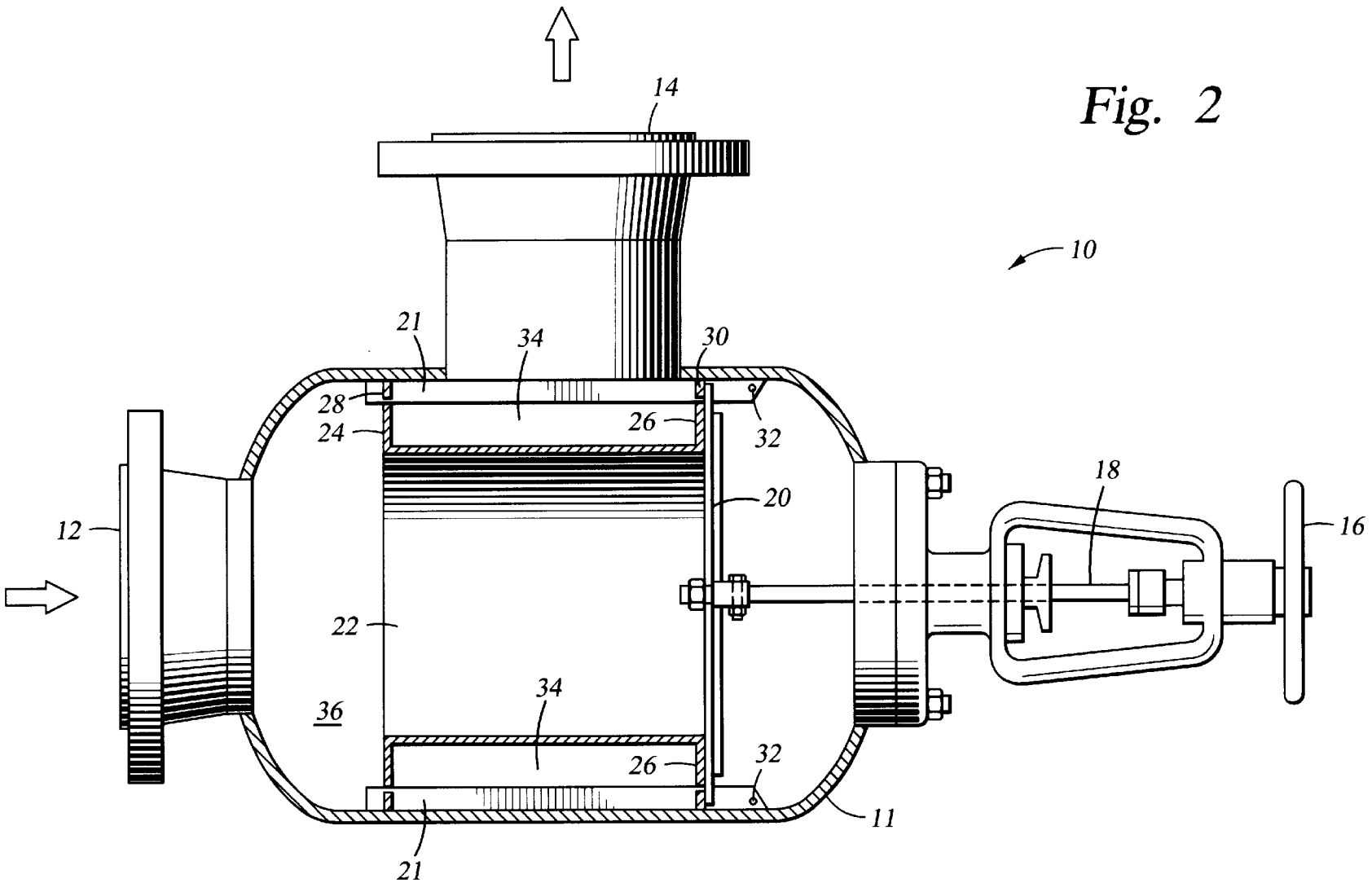
FIG. 2 is a partial section view of the emulsifying device of the present invention.

As shown in FIG. 2, the emulsifier device 10 of the present invention includes a hollow, generally cylindrical body 11, with an inlet 12 and an outlet 14. A control device such as a handwheel 16 is attached by means of a threaded operating stem 18 to a bracket 20 which spans the open proximal end of a cylindrical bobbin 22. The operating stem 18 can be a rising stem type, threaded through a stationary handwheel 16, or any other type well known in the art. The bracket 20 can be an elongated member which extends outwardly near the inner periphery of the body 11. The bracket 20 can be guided by one or more longitudinal guide ribs 21 attached to the body 11.

A first mobile fluid deflector ring 24 is attached as an annular flange extending radially outwardly from the open distal end of the bobbin 22. A second mobile fluid deflector ring 26 is attached as an annular flange extending radially outwardly from the proximal end of the bobbin 22. A first stationary fluid deflector ring 28 is attached as an annular flange extending radially inwardly from the interior wall surface of the body 11, distal to the body outlet 14. A second stationary fluid deflector ring 30 is attached as an annular flange extending radially inwardly from the interior wall surface of the body 11, proximal to the body outlet 14. An annular volume 34 lies around the outside of the bobbin 22, between the mobile fluid deflector rings 24, 26, and between the bobbin 22 and the body 11. This annular volume 34 directs fluid flow to exit the body 11 at the outlet port 14, which is oriented orthogonally to the inlet port 12, thereby eliminating the need for additional internal fluid flow channels to re-direct the fluid flow to an outlet direction aligned with the inlet port 12.

Fluid flow between the outer edges of the mobile fluid deflector rings 24, 26 and the inner edges of the stationary fluid deflector rings 28, 30 creates fluid shear forces, to emulsify the component fluids passing therebetween. The fluid shear edges on the outer peripheries of the mobile fluid deflector rings 24, 26 and the fluid shear edges on the inner peripheries of the stationary fluid deflector rings 28, 30 are located in the outermost vicinity of the cavity 36 of the body 11. Preferably, these fluid shear edges are located in the outermost 10% of the body cavity 36.

The distal limit of the travel of the bobbin 22 can be controlled by abutment of the bracket 20 against one of the stationary fluid deflector rings. The proximal limit of the travel of the bobbin 22 can be controlled by abutment of the bracket 20 against one or more limit pins 32 in the guide ribs 21.

By operation of the handwheel 16, the threaded operating stem 18 moves the bobbin 22 longitudinally within the body 11. This moves the mobile fluid deflector rings 24, 26 to the desired longitudinal position relative to the stationary fluid deflector rings 28, 30. In the bobbin position shown in FIG. 2, the mobile fluid deflector rings 24, 26 are aligned with the stationary fluid deflector rings 28, 30, in the position having the least clearance therebetween, thereby creating the greatest amount of fluid shear. It can be seen that, even in the most distal position of the bobbin 22, fluid flow is allowed past the deflector rings.

Figure 3:
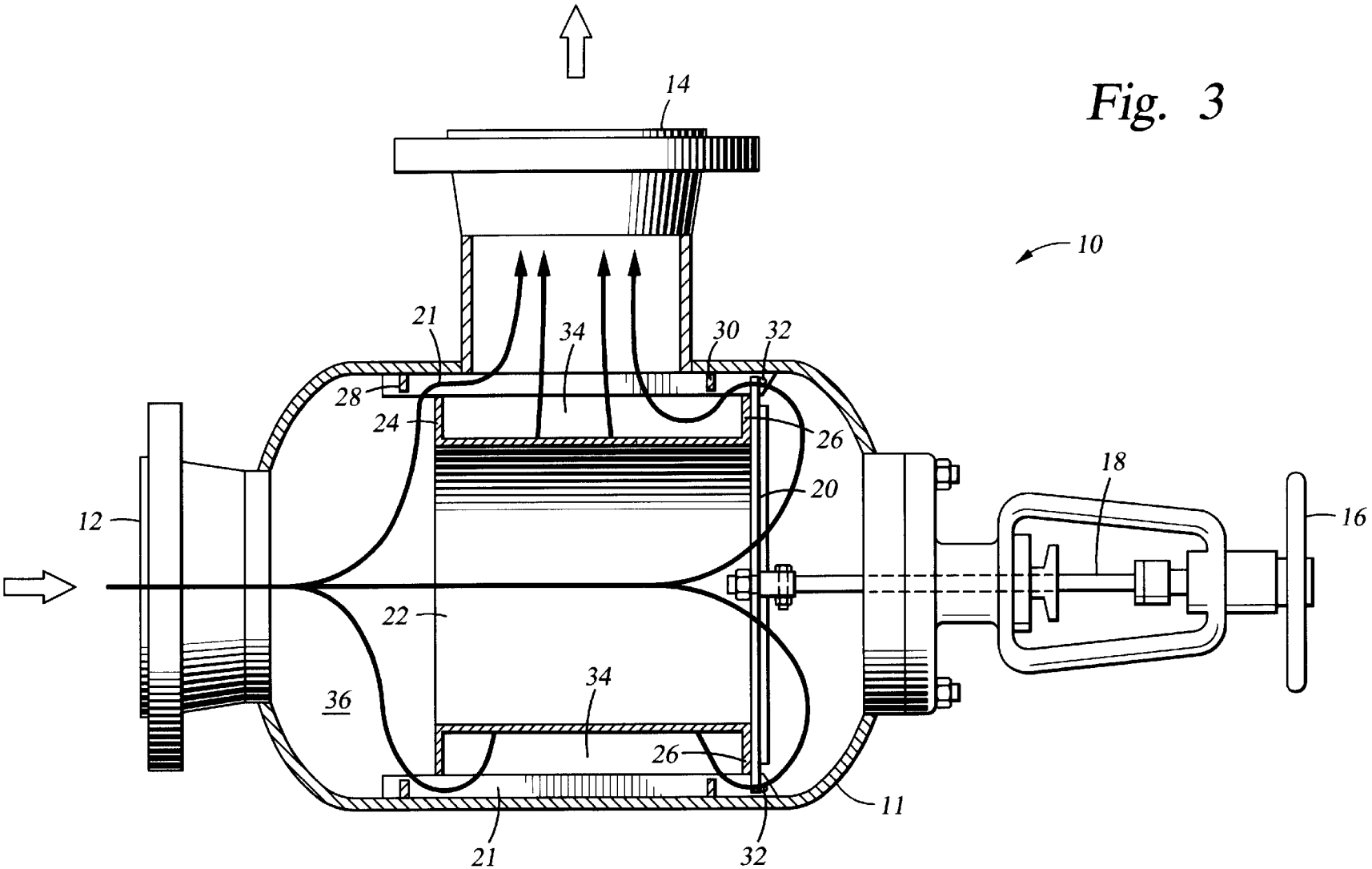
FIG. 3 is a partial section view of the device shown in FIG. 2, showing the flow paths of the fluid being emulsified.

FIG. 3 shows the fluid flow paths through the emulsifying device 10. The component fluids, such as crude oil, salty water, and added water, flow into the body cavity 36 via the inlet port 12. Part of the fluid components flow directly through the distal shear area between the distal stationary fluid deflector ring 28 and the distal mobile fluid deflector ring 24, where emulsification takes place, then through the annular volume 34, and out the outlet port 14. The remainer of the fluid components flow through the center of the cylindrical bobbin 22, through the proximal shear area between the proximal stationary fluid deflector ring 30 and the proximal mobile fluid deflector ring 26, where emulsification takes place, then through the annular volume 34, and out the outlet port 14. The outflow of the downstream desalter (not shown) is analyzed to determine the optimum position of the bobbin between the least restrictive position shown in FIG. 3 and the most restrictive position shown in FIG. 2.

It can be seen that the positioning of the fluid shear edges in the outermost portion of the body cavity 36 and the minimization of interior flow control structures results in a minimization of the flow resistance caused by factors other than the creation of fluid shear forces. This optimizes the emulsification performance of the device 10, while minimizing the pumping capacity required to pump the component fluids.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A device for homogenizing a fluid mixture, comprising:

a hollow body;

a movable deflector frame comprising a substantially cylindrical hollow bobbin within the internal cavity of said body, said bobbin having a cylindrical outer surface;

a first plurality of stationary fluid deflectors fixedly mounted with respect to said body;

a second plurality of mobile fluid deflectors fixedly mounted with respect to said movable hollow bobbin;

a first fluid flow path through the center of said hollow bobbin, then past a first said mobile fluid deflector, then past said cylindrical outer surface of said bobbin to exit said body; and a second fluid flow path past a second said mobile fluid deflector, then past the outside of said bobbin to exit said body, without passing through the center of said bobbin.

2. A homogenizing device as recited in claim 1, wherein free edges of said stationary and mobile fluid deflectors reside in substantially the outer 10% of said internal cavity of said body.

3. A device for homogenizing a fluid mixture, comprising:

a hollow body;

a movable deflector frame comprising a substantially cylindrical hollow bobbin within the internal cavity of said body;

a first plurality of stationary fluid deflectors fixedly mounted with respect to said body;

a second plurality of mobile fluid deflectors fixedly mounted with respect to said movable hollow bobbin;

a first fluid flow path through the center of said hollow bobbin, then past a first said mobile fluid deflector, then past the outside of said bobbin to exit said body; and a second fluid flow path past a second said mobile fluid deflector, then past the outside of said bobbin to exit said body, without passing through the center of said bobbin;

wherein:

said body comprises a substantially cylindrical tube;

said first plurality of stationary fluid deflectors comprise a plurality of annular flanges attached to, and extending radially inwardly from, the interior surface of said body; and said second plurality of mobile fluid deflectors comprise a plurality of annular flanges attached to, and extending radially outwardly from, said bobbin.

* * * * *